US007168912B2

(12) United States Patent
Sun

(10) Patent No.: US 7,168,912 B2
(45) Date of Patent: Jan. 30, 2007

(54) SERIES TYPE FAN DEVICE

(75) Inventor: Sung-Wei Sun, Taipei (TW)

(73) Assignee: Asia Vital Component Co., Ltd., Kaohsiung (TW)

( * ) Notice: Subject to any disclaimer, the term of this patent is extended or adjusted under 35 U.S.C. 154(b) by 164 days.

(21) Appl. No.: 10/968,106

(22) Filed: Oct. 20, 2004

(65) Prior Publication Data

US 2006/0083608 A1 Apr. 20, 2006

(51) Int. Cl.
*F04D 29/52* (2006.01)

(52) U.S. Cl. ..... 415/66; 415/213.1; 415/214.1

(58) Field of Classification Search ..... 415/66, 415/213.1, 214.1; 416/120, 198 R; 361/695
See application file for complete search history.

(56) References Cited

U.S. PATENT DOCUMENTS 6,343,014 B1 * 1/2002 Lin ..... 361/697
6,530,746 B2 * 3/2003 Huang et al. ..... 415/213.1
6,827,549 B1 * 12/2004 Horng et al. ..... 415/68

* cited by examiner

*Primary Examiner*—Ninh H. Nguyen

(57) ABSTRACT

A series type fan device comprises at least a first fan and at least a second fan coupled to each other. The first fan has a joining side with a receiving part at a fan frame thereof and the second fan has a joining side with a projective fixing part corresponding to the receiving part such that the fixing part can be received in the receiving part to allow the first fan being easily detachably connected to the second fan.

3 Claims, 11 Drawing Sheets

FIG 6
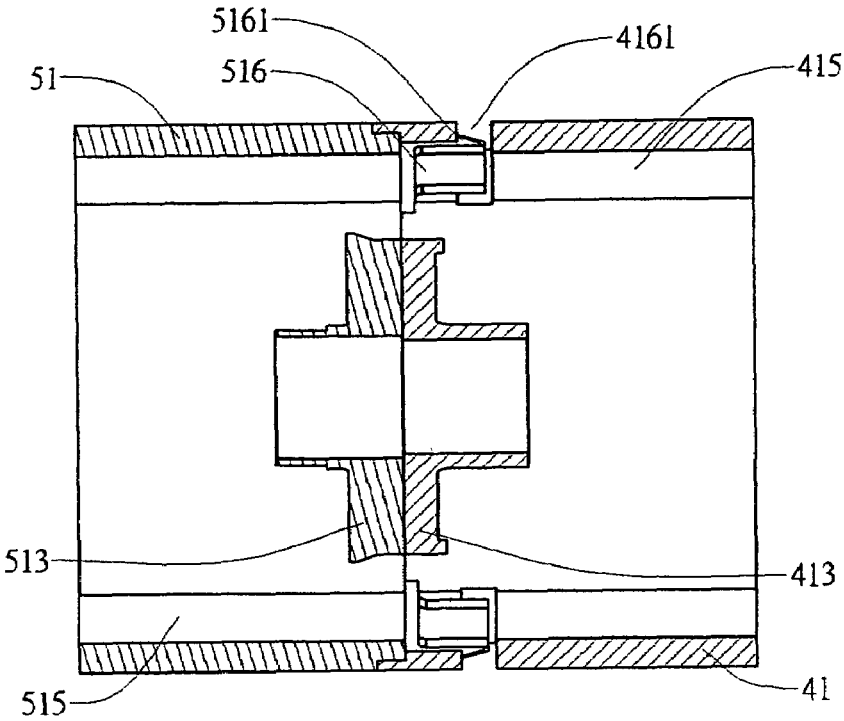
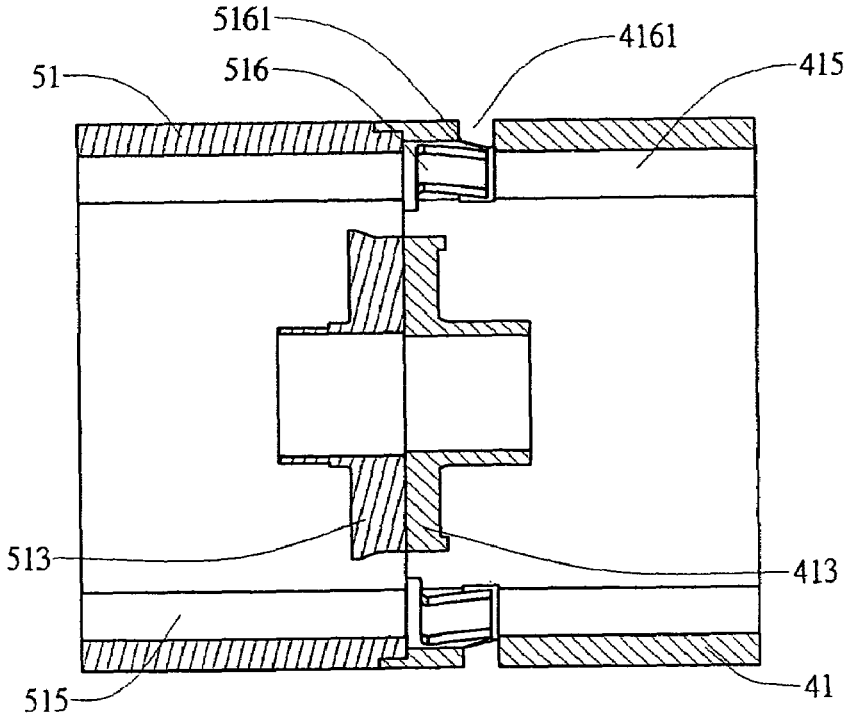
FIG 7

FIG 11
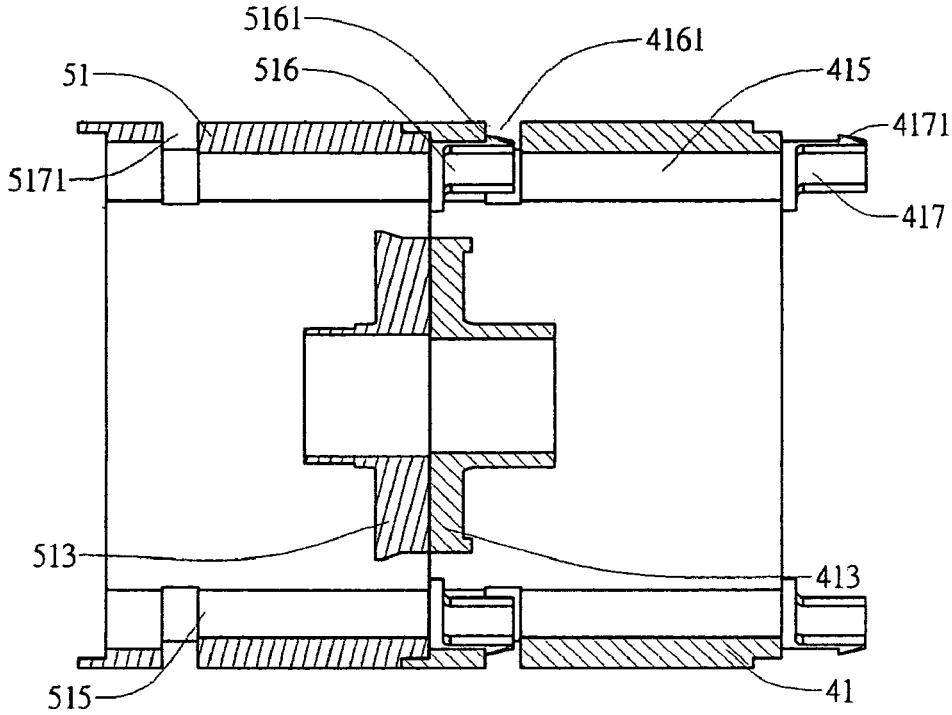
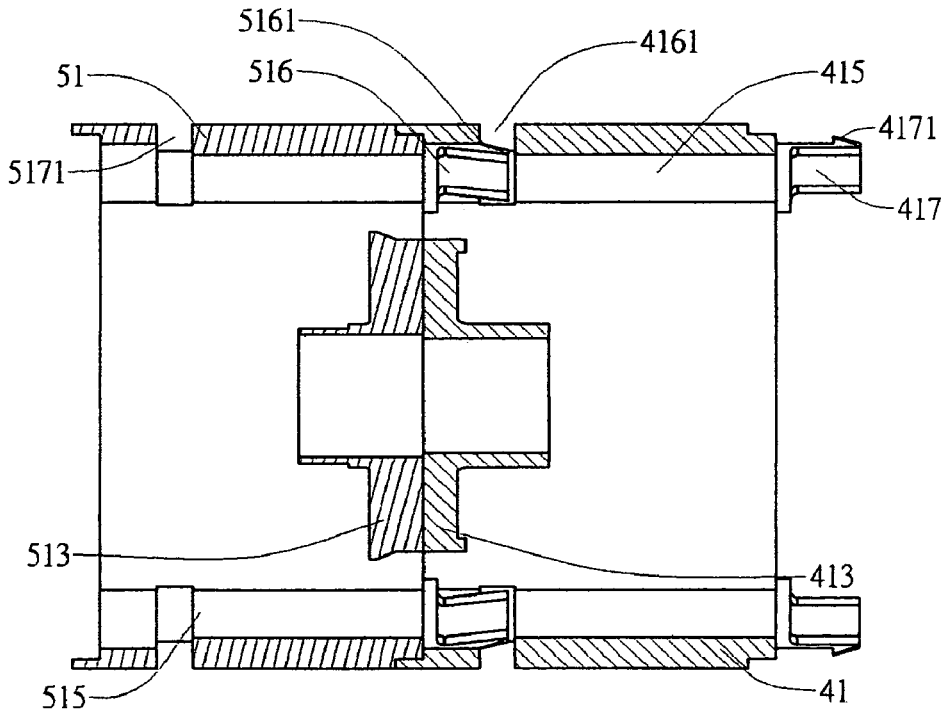
FIG 12

FIG 13
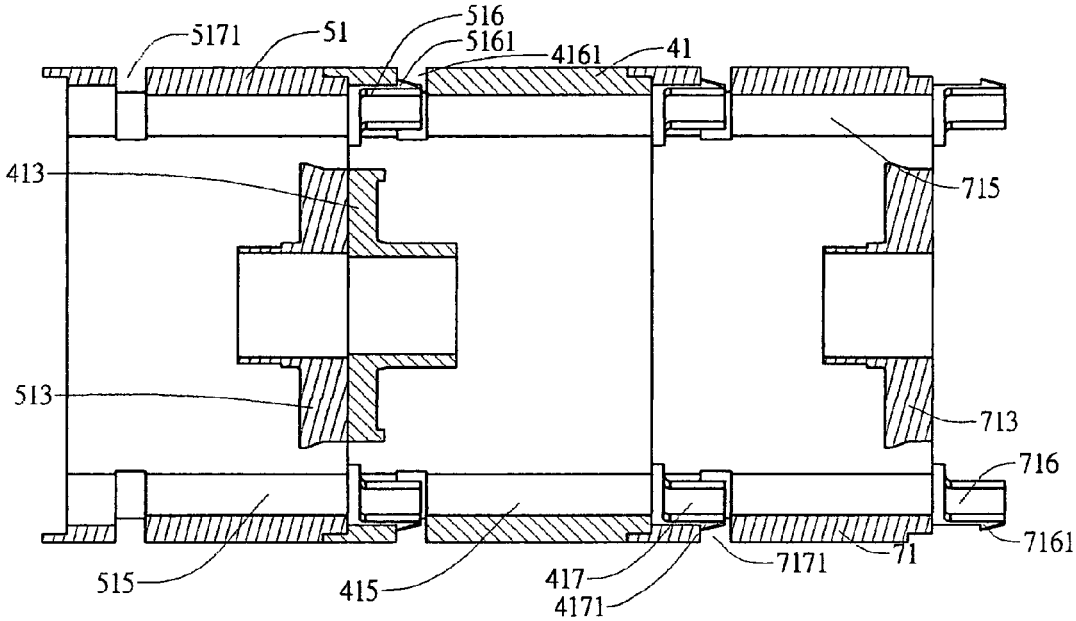
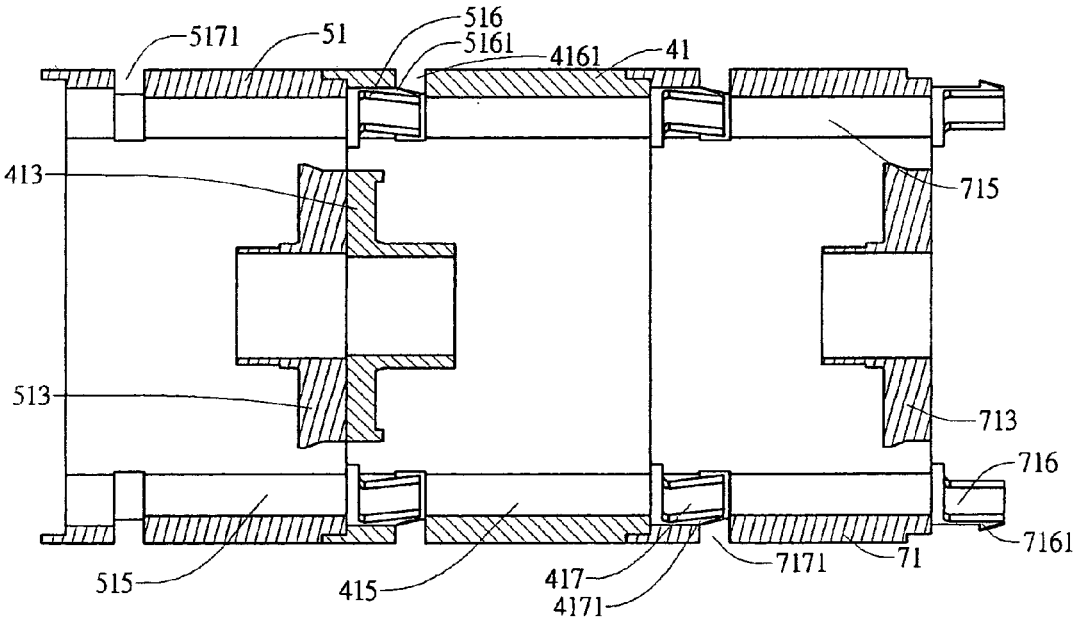
FIG 14

SERIES TYPE FAN DEVICE

BACKGROUND OF THE INVENTION

1. Field of the Invention

The present invention is related to a series type fan device and particularly to assembling structure of two fans in series.

2. Brief Description of the Related Art

Due to electronic components being kept updated and the users keeping to create new demands, problem of heat generation arises along with enhanced effect, treating speed and power too.

Especially in the computer, North bridge chips is easy to produce high temperature too while the performance is enhanced in addition to the central processing unit (CPU) on the main board. The performance of preceding heat generating components is affected seriously if the heat is not removed rapidly and even the life spans thereof becomes shorter accordingly. In order to remove the heat from preceding heat generating components and achieve best performance thereof and prolong the life spans thereof, a heat dissipation device is usually used to attain purpose of heat dissipation. The most popularly used heat dissipation device is the fan and the radiator because of their being conveniently used and lower costs. This is why the manufacturers are interested in developing and researching the fan and the radiator. As for application of cooling fan, in order to dissipate heat from heat generating components effectively, air flow rate of the cooling fan is increased to attain higher heat dissipation efficiency. There are two ways for increasing the air flow rate in which one is to increase size of the fan and the other is to increase rotational speed of the fan. However, the size of the fan is limited with restricted available space and the rotational speed of the fan is limited with the performance of motor. Thus, two identical fans are used to join together in series to increase air flow rate and air pressure for enhancing the hat dissipation efficiency.

Taiwan Patent Official Gazette No. 481434, which is entitled COOLING DEVICE FOR CENTRAL PROCESSING UNIT, discloses a cooling device especially for CPU and the cooling device includes radiation fans and at least two fans. The characteristics of the cooling device is in that the first and second fans are joined in series and a plurality of joining posts are disposed between the two fans to increase pressure of large amount dragged air flow during the radiation fins absorbing the high heat of CPU so as to enhance effects of cooling, temperature lowering and dissipation rate.

The preceding prior art further provides that each of the two fans at the four corners thereof has a through hole respectively for the two fans being fixedly attached to the radiation fins with screws.

However, a problem of the two fans being associated with screws in practice is in that the screws are fastened at a lateral side of one of the two fans so that force exerting points are at the lateral side instead of joining surfaces between the two fans and it results in insufficient joining force to create noise during the fans rotating. In addition, fluid can escape from the clearance between the joining surfaces to influence the air flow rate and degrade the effect of heat dissipation.

Referring to FIGS. 1 to 3, a conventional improved series type fan device includes two fans. The first fan 1 includes a fan frame 11 and a fan wheel 12 disposed in the fan frame 11. The fan frame 11 at two lateral sides thereof has an inlet 111 and an outlet 112 respectively and four corners of the fan frame 11 are provided with a through hole 113 for being passed through with a screw respectively. The periphery of the fan frame 11 at the outlet 112 side thereof is provided with a projective engaging part 114. The second fan 2 includes a fan frame 21 and a fan wheel 22 disposed in the fan frame 21. The fan frame 21 at two lateral sides thereof provides an inlet 211 and an outlet 212 respectively and four corners of the fan frame 21 are provided with a through hole 213 for being passed through with the screw 3. The periphery of the fan frame 21 at the inlet 212 side thereof is provided with a receiving part 214 corresponding to the engaging part 114 of the first fan 1. The first and second fans can be joined to each other in series by way of the engaging part 114 fitting with the receiving part 214 and the screw 3 passing through the through holes 113, 213 respectively.

However, the preceding conventional improved series type fan device still has a problem inside that it is difficult to detach the engaging part 114 from the receiving part 214 unless a tool such as a screw driver to remove the engaging part 114 from the receiving part 214 with force while the first fan 1 is separated from the second fan. Hence, it leads a lot of inconvenience to the user.

SUMMARY OF THE INVENTION

An object of the present invention is to provide a series type fan device which is very easy to be detached after being assembled.

BRIEF DESCRIPTION OF THE DRAWINGS

The detail structure, the applied principle, the function and the effectiveness of the present invention can be more fully understood with reference to the following description and accompanying drawings, in which:

FIG. 6 is a sectional view of the first embodiment of series type fan device according to the present invention;

FIG. 7 is a sectional view of the first embodiment of series type fan device according to the present invention illustrating two separated fans;

FIG. 11 is a sectional view of the second embodiment of series fan device according to the present invention illustrating two fans being assembled together;

FIG. 12 is a sectional view of the second embodiment of series fan device according to the present invention illustrating two fans being separated from each other;

FIG. 13 is a sectional view of the second embodiment of series fan device according to the present invention illustrating three fans being assembled together; and FIG. 14 s a sectional view of the second embodiment of series fan device according to the present invention illustrating three fans being separated from each other;

DETAILED DESCRIPTION OF THE INVENTION

Figure 1:
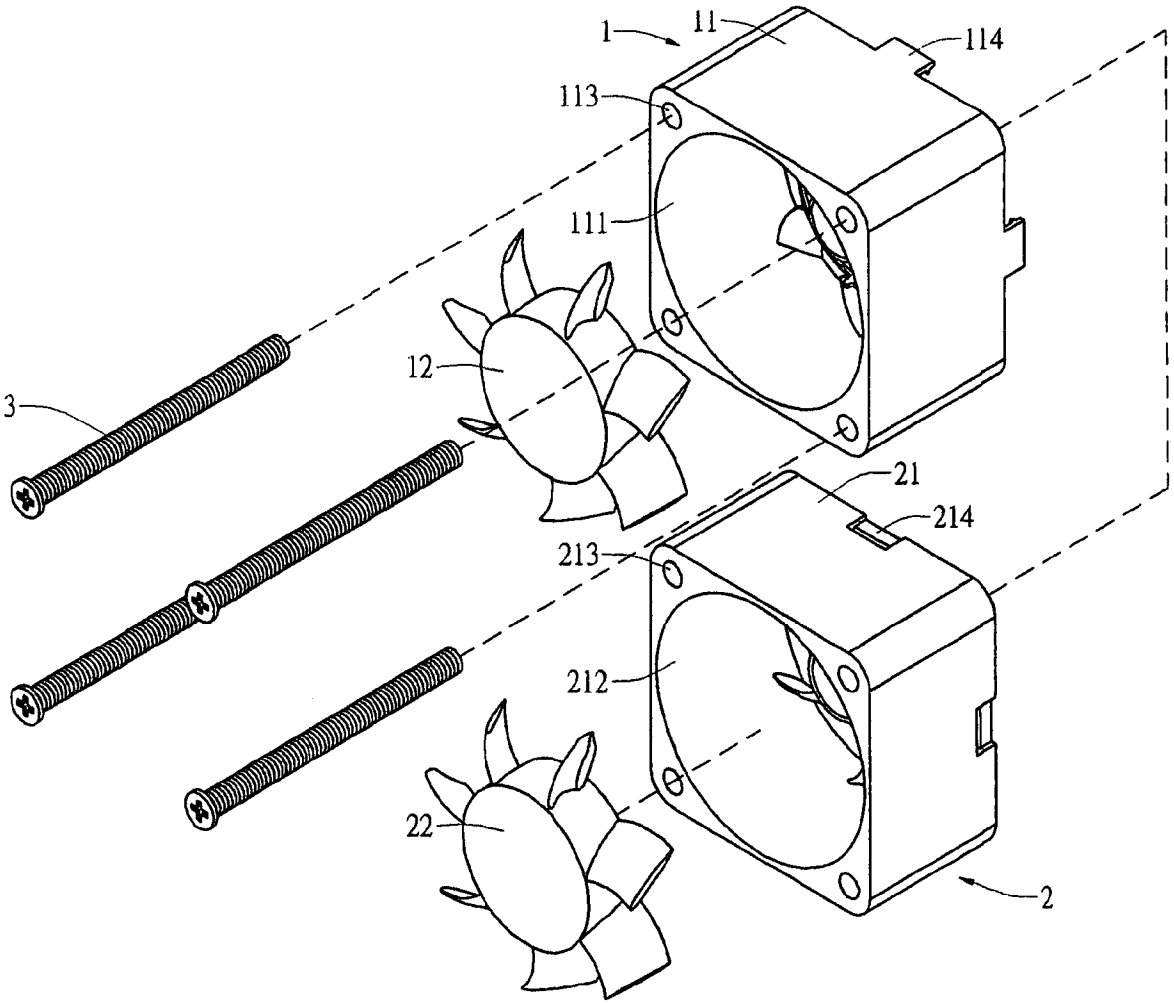
FIG 1 (PRIOR ART)
FIG. 1 is an exploded perspective view of the conventional series type fan device.
Figure 2:
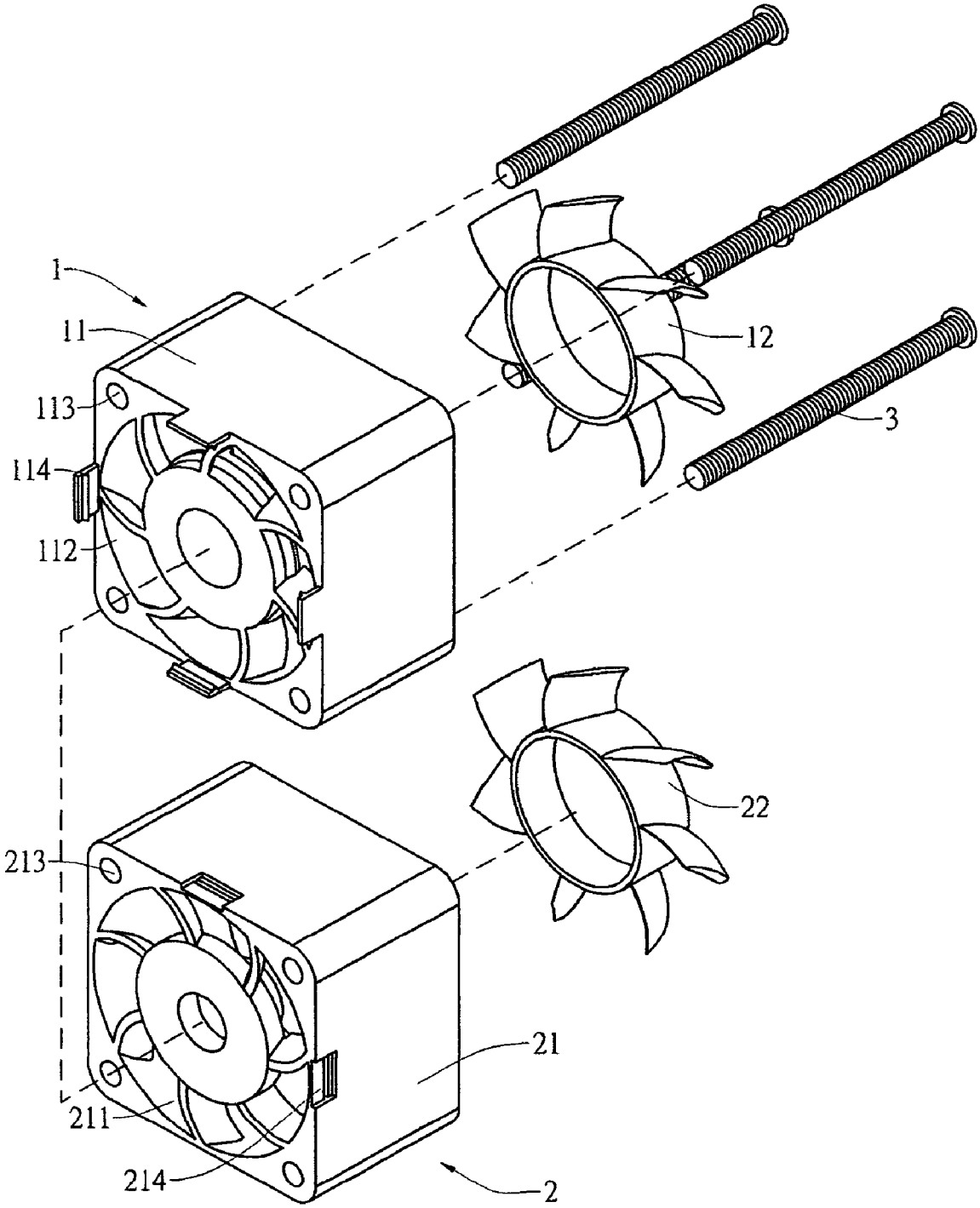
FIG 2 (PRIOR ART)
FIG. 2 is another exploded perspective view of the conventional series type fan.
Figure 3:
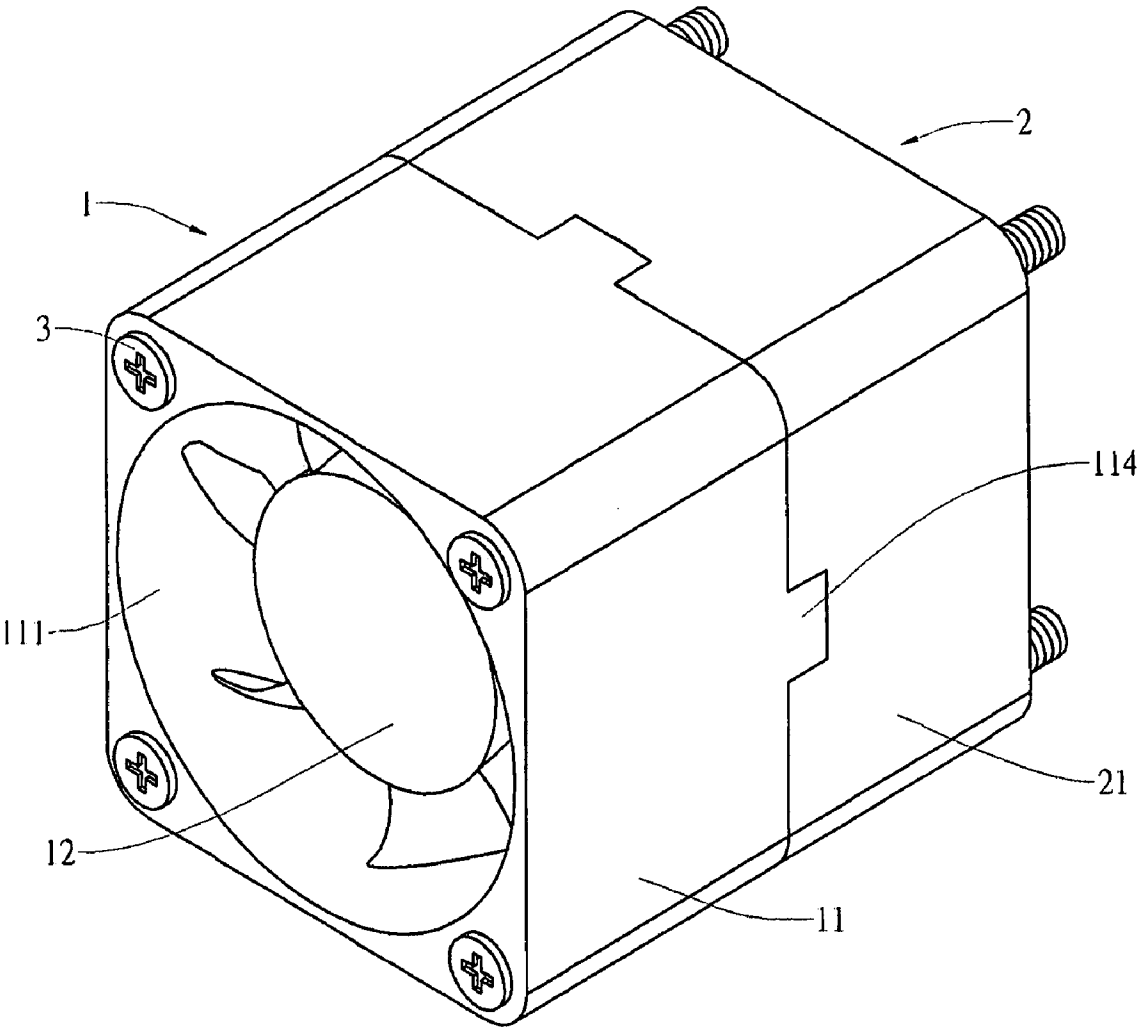
FIG 3 (PRIOR ART)
FIG. 3 is an assembled perspective view of the conventional series type fan device.
Figure 4:
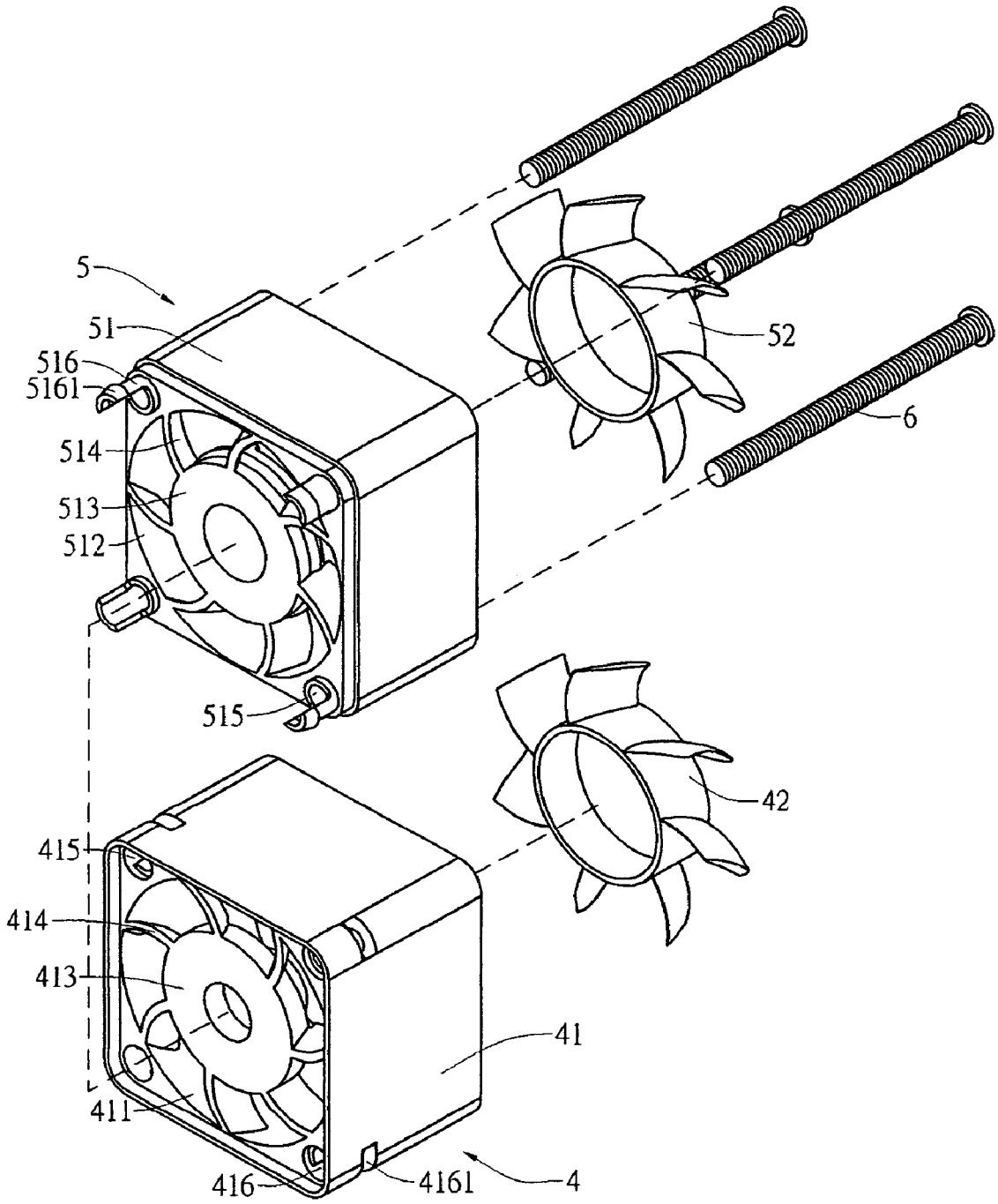
FIG. 4 is an exploded perspective view of the first embodiment of series type fan device according to the present invention.

Referring to FIG. 4, the first embodiment of a series type fan device according to the present invention comprises a first fan 4 and a second fan 5. The first fan 4 further includes a fan frame 41 and a fan wheel 42. The fan frame 41 has a chamber to receive the fan wheel 42 and the joining side 411 of the fan frame 41 has a hub seat 413 and a static wing set 414, which is provided with radial arrangement and connecting with the hub seat 413 and the fan frame 41. The fan frame 41 at the four corners thereof at least has a series connecting part 415 for being passed through with a fastening element 6 respectively. Further, the joining side 411 of the fan frame 41 at least has a receiving part 416 formed from a recess surrounding the series connecting part 415. The receiving part 416 has an opening 4161. The second fan 5 includes a fan frame 51 and a fan wheel 52. The fan frame 51 has a chamber to receive the fan wheel 52 and a joining side 512 of the fan frame 51 has a hub seat 513 and a static wing set 514, which is provided with radial arrangement and connecting with the hub seat 513 and the fan frame 51. The fan frame 51 at the four corners thereof at least has a series connecting part 515 for being passed through with a fastening element 6 respectively. Further, the joining side 511 of the fan frame 41 at least has a projective fixing part 516 corresponding to the receiving part 416 of the first fan 4. The fixing part 516 surrounds the series connecting part 515 and forms with an engaging unit 5161 with a reversed hook shape to engage with the opening 4161 of the receiving part 416 in the first fan 4.

Figure 5:
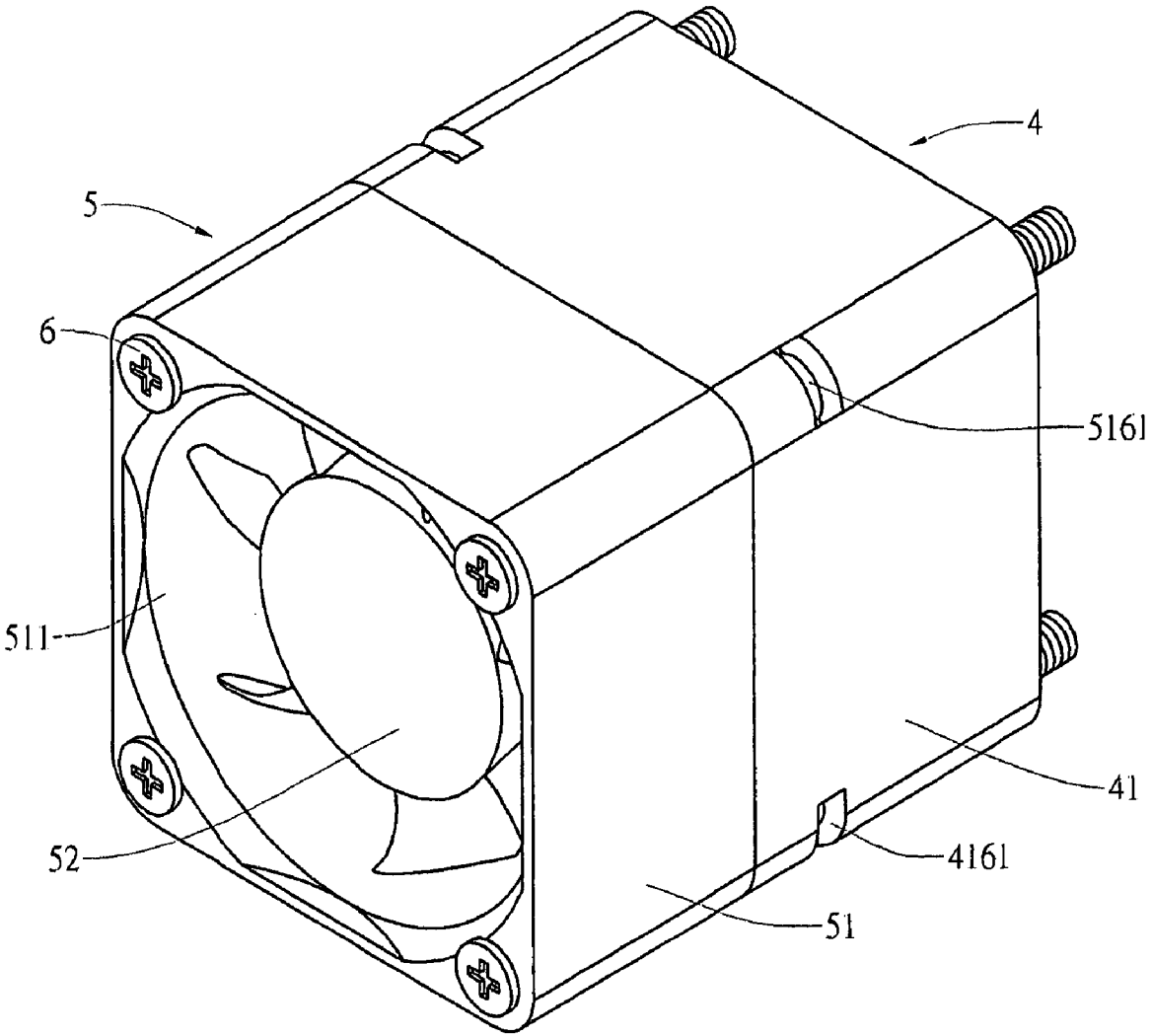
FIG. 5 is an assembled perspective view of the first embodiment of series type fan device according to the present invention.
Figure 8:
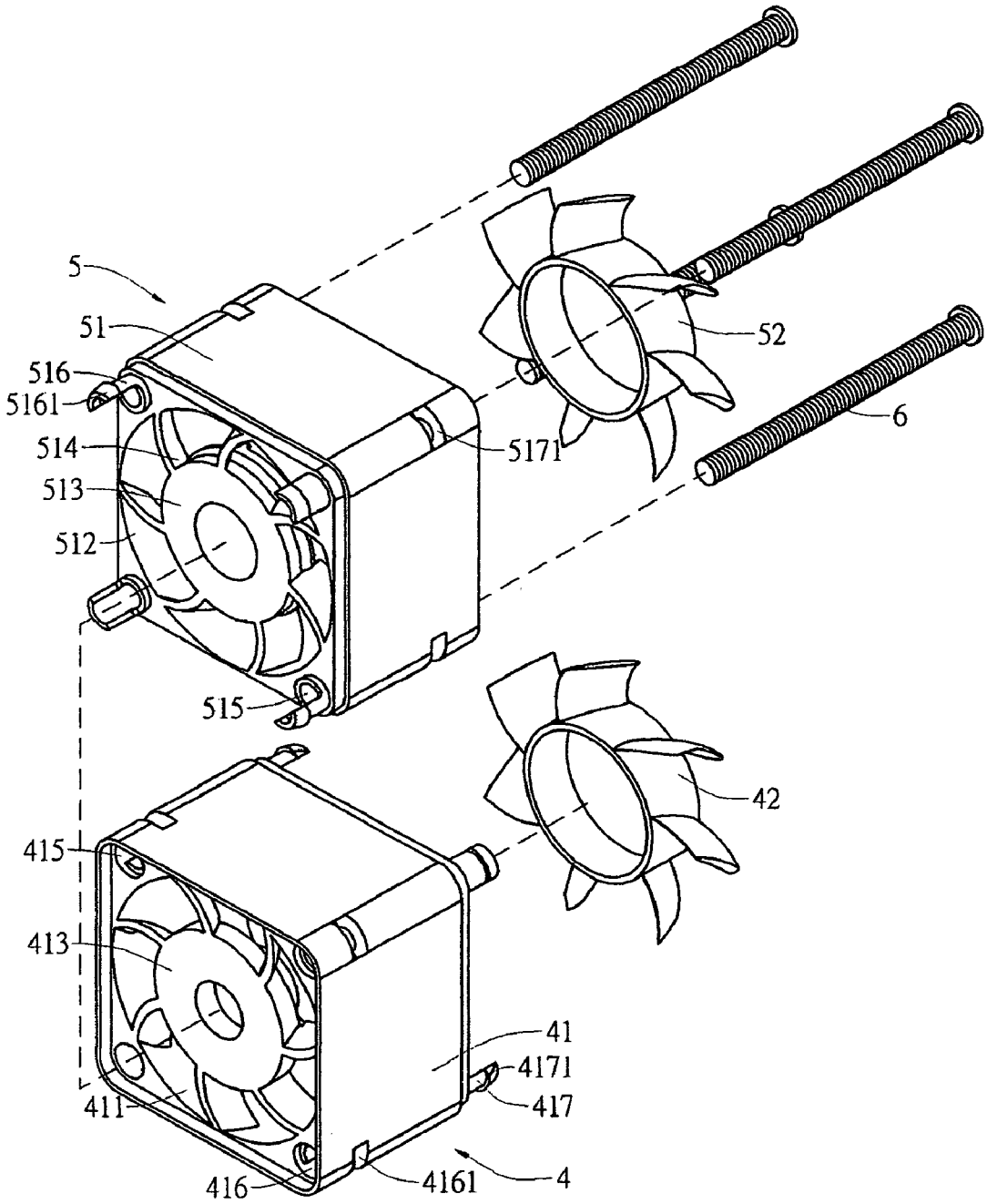
FIG. 8 is an exploded perspective view of the second embodiment of series type fan device according to the present invention.
Figure 9:
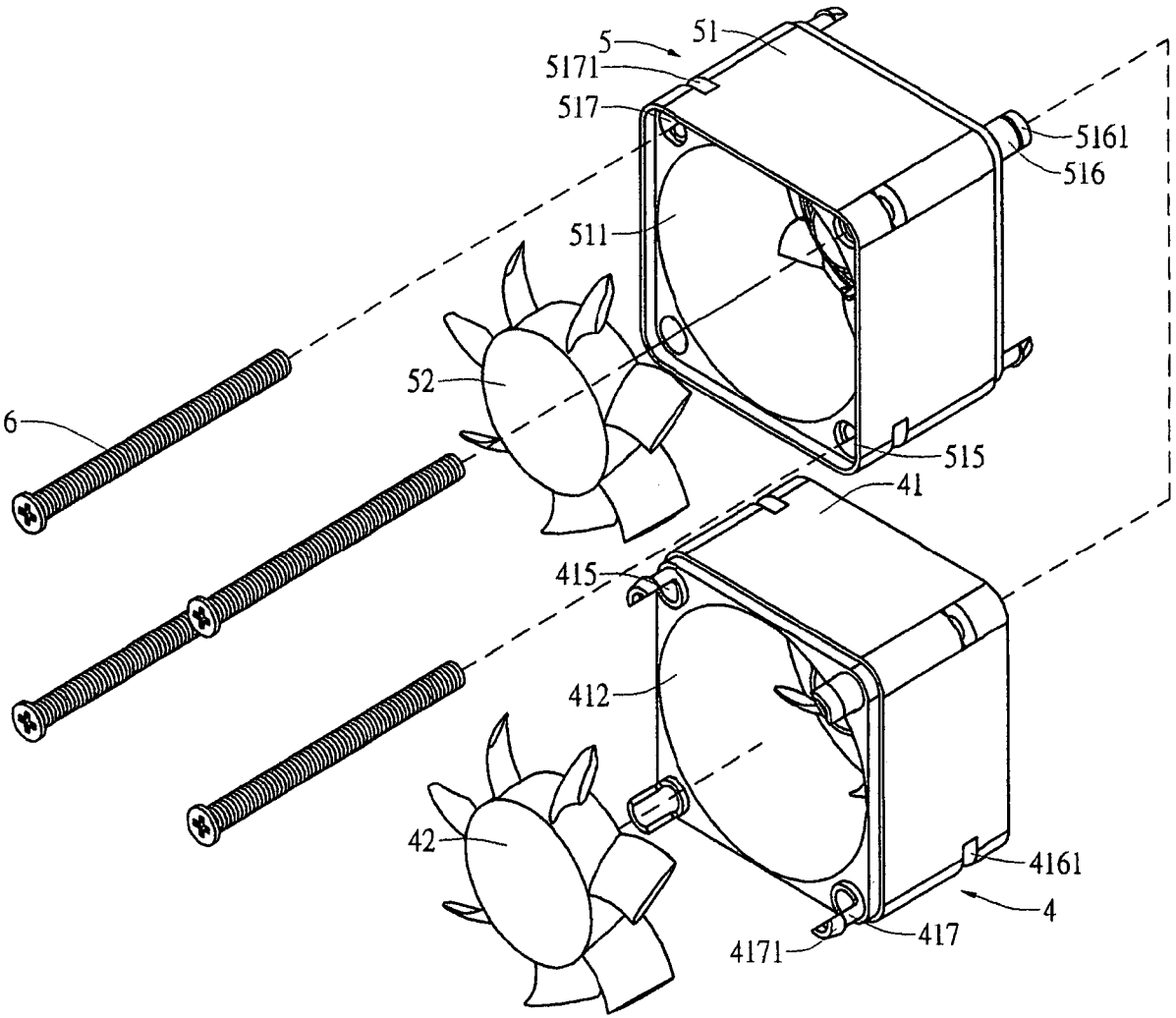
FIG. 9 is another exploded perspective view of the second embodiment of series type fan device according to the present invention.
Figure 10:
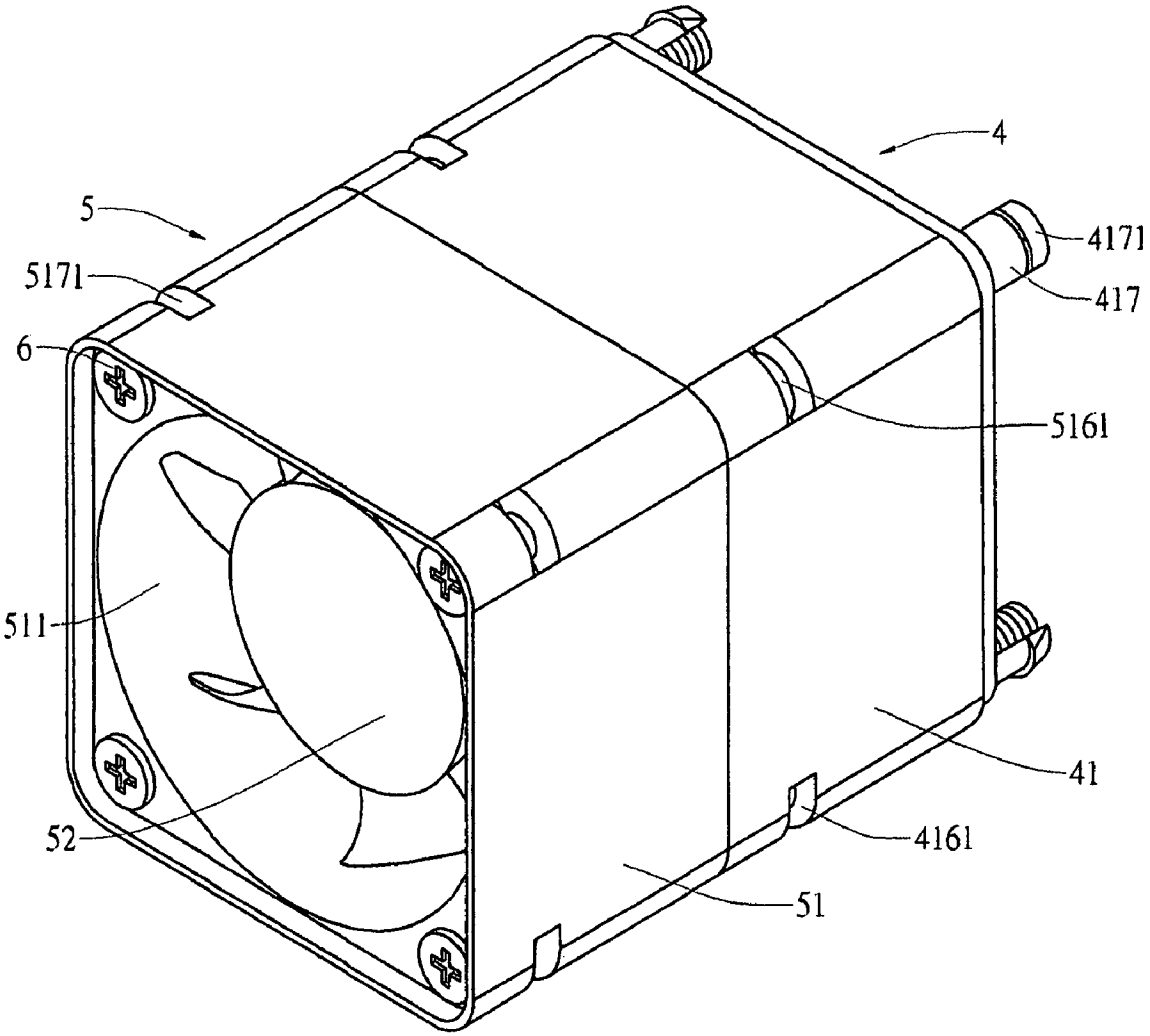
FIG. 10 is an assembled perspective view of the second embodiment of series type fan device according to the present invention.

Referring to FIGS. 4, 5 and 6, when the series fan device of the present invention is assembled, the joining side 411 of the first fan 4 is disposed to face the joining side 512 of the second fan 5. The receiving part 416 of the first fan 4 is received in the fixing part 516 such that the engaging unit 5161 of the fixing part 516 can be pressed into the recess shaped receiving part 416 to reach the opening 4161 and bounce the hook back for engagement. In this way, the fixing part 516 can couple with the receiving part 416 of the first fan 4 to provide transverse joining force. The engaging unit 5161 is joined to the opening 4161 can provide longitudinal joining. Hence, the first fan 4 can be joined to the second fan 5 in series firmly.

Referring to FIGS. 4 and 7, the engaging unit 5161 of the fixing part 516 in the second fan 5 can be pressed downward to release the engaging unit 5161 from opening 4161 such that the first fan 4 can detach from the second fan 5 smoothly to provide a feature of good detachability after being connected in series and overcome the problem that the conventional series type fan device is difficult to be detached from each other.

Referring to FIGS. 8 to 14, the second embodiment of the series type fan device according to the present invention is illustrated. The entire structure and function of the second embodiment are similar to the preceding embodiment and identical parts with the same designated numerals will be explained further. Another side 412 of the first fan 4 is formed with at least a fixing part 417 and the fixing part 417 has an engaging unit 4171. The second fan 5 at another side 511 thereof at least provides a receiving part 517 with an opening 5171. The arrangement of the present embodiment at least allows two the first fans 4 and two the second fans 5 being detached from each other easily after being coupled with each other in series. Further, the arrangement at least allows two the first fans 4, two the second fans 5, two the third fans and more being detached from each other easily after being coupled with each other in series.

While the invention has been described with referencing to preferred embodiments thereof, it is to be understood that modifications or variations may be easily made without departing from the spirit of this invention, which is defined by the appended claims.

What is claimed is:

1. A series type fan device comprising;

at least a first fan, having a first fan frame with a first joining side. and the first joining side having a receiving part; and at least a second fan, having a second fan frame with a second joining side opposite to the first joining side, the second joining side having a projective fixing part to be received in the receiving part such that the second fan is capable of coupling with the first fan in series;

characterized in that the receiving part has an opening passing through the first fan frame to be hooked with the fixing part of the second fan for the first fan being detachably connected to the second fan easily.

2. The series type fan device as defined in claim 1, wherein the fixing part has an engaging unit to hook the opening of the receiving part.

3. The series type fan device as defined in claim 2, wherein the fixing part has a shape of hook.

* * * * *